United States Patent [19]

Schwarz

[11] 4,120,327

[45] Oct. 17, 1978

[54] DOUBLE-LIFT DOBBY

[75] Inventor: Rudolf Schwarz, Horgen, Switzerland

[73] Assignee: Staeubli Ltd., Switzerland

[21] Appl. No.: 800,286

[22] Filed: May 25, 1977

[30] Foreign Application Priority Data

May 28, 1976 [CH] Switzerland ..... 6745/76

[51] Int. Cl.[2] ..... D03C 1/06

[52] U.S. Cl. ..... 139/71; 139/331

[58] Field of Search ..... 139/66 R, 68, 71, 72, 139/73, 74, 331; 66/154

[56] References Cited

U.S. PATENT DOCUMENTS

| | | | |
|---|---|---|---|
| 3,441,060 | 4/1969 | Schwarz | 139/71 |
| 3,459,236 | 8/1969 | Faure | 139/71 |
| 3,602,265 | 8/1971 | Palau et al. | 139/71 |
| 3,680,601 | 8/1972 | Palau | 139/68 |

*Primary Examiner*—Henry S. Jaudon

*Attorney, Agent, or Firm*—Blanchard, Flynn, Thiel, Boutell & Tanis

[57] ABSTRACT

A negative double-lift dobby, Hattersley system, comprising controlled holding hooks and draw hooks. In order for the holding hook to be able to be controlled at any time, namely independent from the position of the draw hook, by the pegs of the pattern card, at least one of the cooperating hooks is arranged shiftably against the force of a spring. The invention facilitates the control of fast running weaving machines and permits through the direct control of the heddles an increase in durability by reducing faulty controls and through the possibility of the precontrol an increase of the speed of the weaving machine.

5 Claims, 7 Drawing Figures

DOUBLE-LIFT DOBBY

FIELD OF THE INVENTION

This invention relates to a negative double-lift dobby, Hattersley system, comprising one baulk per heddle, on the ends of which baulk are mounted draw hooks which cooperate with selectively controlled arrester or holding hooks, and which can be controlled prior, during or after engagement of the draw hooks.

BACKGROUND OF THE INVENTION

From Swiss Patent No. 394,071 (corresponds to U.S. Pat. No. 3,285,291), a dobby of the Hattersley system has become known, in which the movement of the baulks which finitely control the end position of the heddles, is carried out by bars which act with a pushing force onto the ends of the baulk. This pushing force takes place constantly in the same rhythm. To control the position of the baulk, and with it also of the attached heddle, cooperating draw and arrester or holding hooks are used. The latter are controlled from a pattern card such that the draw hooks engage or do not engage, depending on the patternlike upper shed or lower shed position of the heddle.

However, a dobby is also known, in which in order to shorten the control time, or rather to increase the operating rhythm, certain control functions, in particular reading of a pattern card and transmitting of the read information is advanced or stored into the actual operating time.

All such inventions have the object of increasing the operating speed and the economics of the dobbies.

The result of such a development for a dobby according to Swiss Pat. No. 394,071 is described more in detail in Swiss Pat. No. 472,517 (corresponds to U.S. Pat. No. 3,441,060). Here a holding hook is shown, which permits an anticipatory control. This holding hook consists of two two-arm levers, which are supported on shafts and can be swung against one another against the force of springs. High speeds can be achieved therewith.

The purpose of the invention is to find a simple solution for reducing the manufacturing and installation expenses and to achieve a greater work output.

This is achieved inventively in a negative double-lift dobby of the above-mentioned type by the holding hooks being able to be controlled by a pattern card and being able to be moved into the range of movement of the draw hooks and a deflecting spring being arranged on the draw or holding hooks, which deflecting spring permits a yielding of the holding hooks with respect to the connecting position.

BRIEF DESCRIPTION OF THE DRAWINGS

Exemplary embodiments of the subject matter of the invention are illustrated in the drawings, in which.

DETAILED DESCRIPTION

Figure 1:
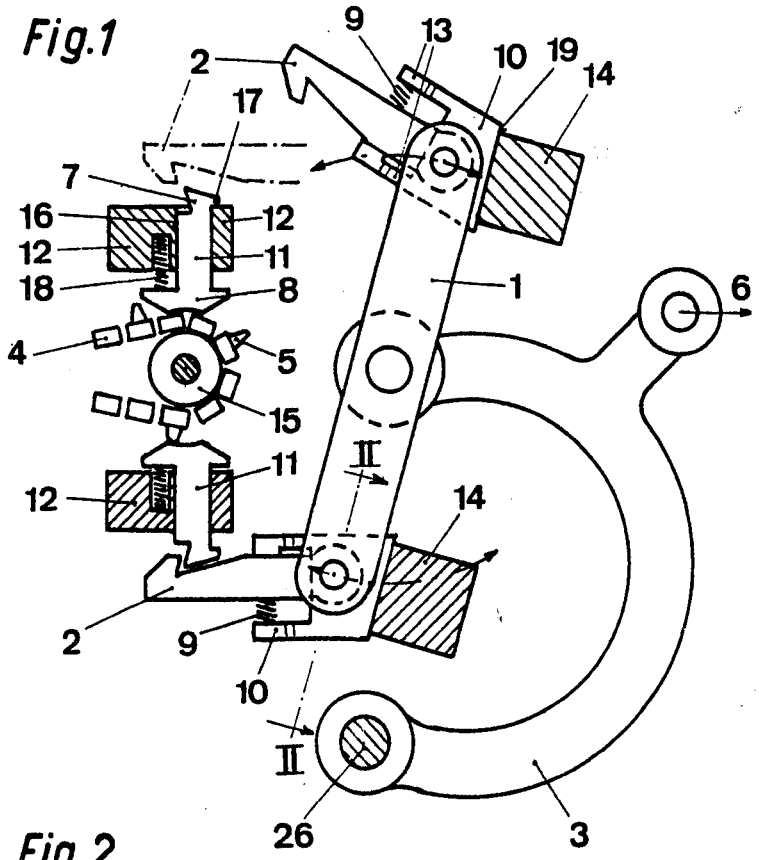
FIG. 1 is a schematic side view of the pertinent parts of a negative double-lift dobby of the Hattersley system in the principal structure according to U.S. Pat. No. 3,441,060 having inventive holding hooks embodied therein.
Figure 2:
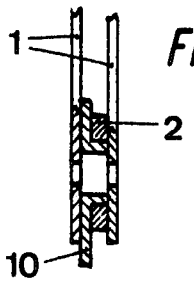
FIG. 2 is a cross-sectional view taken along the line II—II of FIG. 1.
Figure 3:
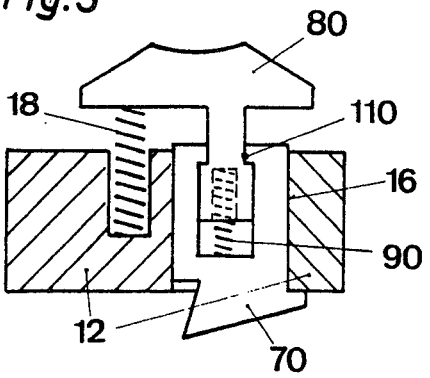
FIGS. 3 and 4 are side and cross-sectional views, respectively, of a modified embodiment of a holding hook.
Figure 4:
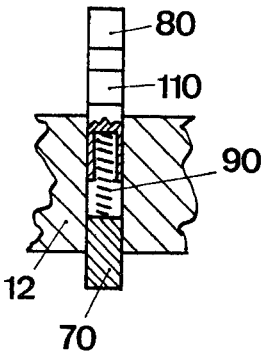

The structure of the dobby in the exemplary embodiment according to FIG. 1 is the same type of a negative dobby mechanism as is discussed in Swiss Pat. No. 394,071. A jack lever 3 is connected pivotally to the center of the baulk 1. The jack lever 3 is pivotally supported on a shaft 26. Reference numeral 6 identifies the lifting device to the not illustrated heddle. A draw hook 2 is pivotally connected to each end of the baulk. Each draw hook cooperates with a holding slide 11, the position of which is influenced by pegs 5 on a pattern card 4. One end of the slide 11 has an enlarged glide foot 8 thereon for engaging and reading the cams 5, the other end of the slide is constructed as an actual hook 7. Each slide 11 is supported translatorically slidably in a fixed bar 12. The hook-shaped end 7 has a barb 17 thereon which engages and is supported on the bar 12. A return spring 18 is provided between the glide foot 8 and the bar 12 and presses the slide 11 and thus also the glide foot at all times in direction of the rotatable drive cylinder 15 supporting the pattern card 4.

A bearing plate 10 is also pivotally supported on each end of the baulk 1 about an axis which is coaxial with respect to the pivot axis for the draw hook. The bearing plates are each U-shaped, wherein each of the base sides 19 engages the back and forth swinging pusher bars 14. The legs 13 of the bearing plate 10 are enlarged so that the path of swing of the draw hook 2 in the baulk plane is limited by the legs. Between the outer leg 13 and the draw hook 2 there is arranged a deflecting spring 9, which presses the draw hook at all times toward and against the side of the hook 7 of the associated slide 11. The guideway for the slide 11 in the bar 12 is constructed such that the slide 11 projects only slightly beyond the bar, preferably on the one end only for the dimension of the hook 7 or on the other end of the glide foot 8 and its path of movement which is caused by the cam.

Figure 7:
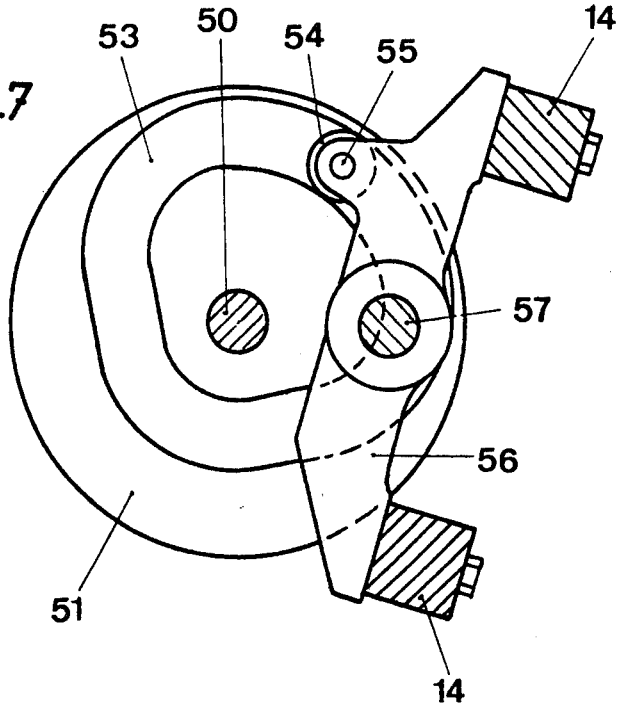
FIG. 7 is a side view of an example of a drive for the push bars of the draw hooks.

FIG. 7 schematically illustrates a drive mechanism for the bars 14 which engage bearing plates 10 to effect a driving of the ends of the baulk 1 back and forth. The illustrated drive is provided on the side or sides of the dobby, while the bars extend transversely through the machine. The shaft 50 which is driven by the drive motor has a cam plate 51 fixed thereto and which is provided with a cam groove 53. A guide roller 54, which is supported on a bolt 55 of a two-arm lever 56, slides in the cam groove 53. The two-arm lever 56 is itself pivotally mounted on a stationary shaft 57 and the two bars 14 are secured to each arm at each of its ends.

OPERATION

The described dobby operates as follows: A not illustrated downpull spring of the weaving heddle is pulled to the right by the lifting device 6 of the jack levers 3 and thus also the baulk 1. The bearing plates 10 engage — when the draw hook does not engage the holding hook 7 — the bars 14. These are swung back and forth constantly in direction of the arrow by the drive mechanism which is illustrated in FIG. 7. During a forward movement of one baulk end, the arrester or holding abutting draw hook 2 reaches the engagement area of the hook 7 of the associated slide 11. If one peg 5 of the pattern card 4 has controlled the slide 11 — see the lower slide 11 in FIG. 1 — then the draw hook 2 snaps into engagement with the hook 7 of the slide into the illustrated position. This snapping action is possible since the draw hook is held in its position only by the deflecting spring 9. If a control of the slide 11 does not take place, namely if no cam 5 is below the slide — see the upper slide 11 in FIG. 1 — then the slide is lowered under the action of the return spring 18. An engagement of the draw hook 2 does not take place. The baulk end swings back with the bar 14.

With reference to FIGS. 3 to 6, a modified embodiment is discussed, wherein in each case the lower members are illustrated. The slide 110 (FIGS. 3 and 4) is supported in the guideway 16 of the bar 12 and consists of two engaging parts 70 and 80, which form the hook and the glide foot. The deflecting spring 90 is arranged between the two parts, which deflecting spring separates the hook 70 and the glide foot 80, while the return spring 18 presses the entire slide 110 against the pattern card.

Figure 5:
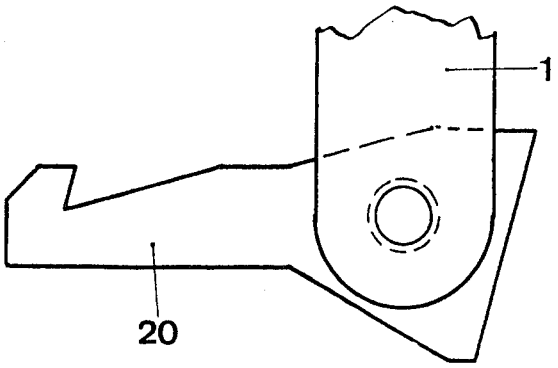
FIGS. 5 and 6 are side and cross-sectional views, respectively, of the associated draw hook of the baulk end.
Figure 6:
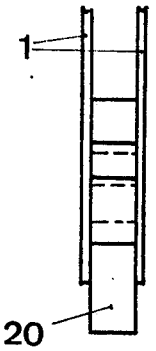

At the end of the baulk 1 in FIGS. 5 and 6, the draw hook 20 which cooperates with the slide 110 does not have a bearing plate. The rear part of the hook is constructed directly as a stop for the bar.

In the modified embodiment with the details according to FIGS. 3 to 6, the draw hook does not snap over the slide hook, but the part 70 of the slide 110 slides away below the draw hook 20 for engagement. Otherwise the operation remains the same.

The slide can be controlled electrically, pneumatically or hydraulically from a pattern card.

It is possible with the described dobby to carry out the control function prior to the shed change having been concluded or shortly prior to the end or after the conclusion of the shed change.

By supporting the slide 11, 110 in a rigid bar 12, with slightly projecting holding hooks 7, 70, one obtains a hook which is readily movable with low mass and is additionally supported rigidly. A danger of bending or resiliency of the bar is avoided by the massive structure of the nonmovable parts.

The pressure between holding hooks 11, 110 and control pegs 5 is reduced upon the arrangement of a slide in a bar, particularly compared with a construction with a two-arm jack lever. As is illustrated, the slide 11, 110 or its guideway lies approximately perpendicularly with respect to the direction of swing of the draw hook 2, 20 so that the forces exerted by the frame onto the draw hook are not transmitted onto the pegs 5 and thus the pattern card 4.

The speed can be increased with the described dobby.

Although particular preferred embodiments of the invention have been disclosed in detail for illustrative purposes, it will be recognized that variations or modifications of the disclosed apparatus, including the rearrangement of parts, lie within the scope of the present invention.

The emobdiments of the invention in which an exclusive property or privilege is claimed are defined as follows:

1. In a negative double-lift dobby comprising an information containing pattern card, a baulk, draw hooks mounted at opposite ends of said baulk, a jack-lever pivotally connected to a mid-section of said baulk, control means for cyclically oscillating said baulk and holding hook members and support means therefor supporting said holding hook members for movement into and out of the path of movement of said draw hooks, the improvement comprising wherein said support means is a guideway in a stationary bar, wherein said holding hook members are reciprocally slidably supported in said guideway between opposite first and second limit positions, said holding hook members each having a holding hook thereon and selectively controlled means remote from said holding hook responsive to said information embodied on said pattern card for effecting a sliding movement of said holding hook member in said guideway between said first and second limit positions, each of said holding hooks being positioned in the path of movement of said draw hooks when in one of said first and second limit positions, and resilient means for effecting a yielding of the position of at least one of said draw hook and said holding hook to facilitate the passage of said draw hook past said holding hook when said holding hook is in said one of said first and second limit positions.

2. The improved dobby according to claim 1, wherein said selectively controlled means is a reading element for the pattern card and wherein second resilient means are provided for urging said reading element into engagement with said pattern card, said second resilient means yielding to the information on said pattern card to cause said holding hook member to move in said guideway, said draw hooks being pivotally supported on said ends of said baulk, wherein limit means are provided for limiting the range of pivotal movement for said draw hooks and the position in the mentioned range is determined by the first-mentioned resilient means.

3. The improved dobby according to claim 2, wherein said dobby includes a pair of movable pusher bars, wherein each baulk end has additionally to said draw hook one U-shaped bearing plate having a base and two legs, wherein each of said bases is positioned on said baulk to become operatively engaged with said pusher bar and said legs define said limit means for limiting the movement of said draw hook, said first-mentioned resilient means including a spring located between one leg and the corresponding draw hook.

4. The improved dobby according to claim 1, wherein said holding hook members are two-part slides which are slidable in said guideway, said slides having at one end and on one part said holding hook and at the other end and on the other part said selectively controlled means, wherein said two parts are movable relative to each other and between said two parts of said slide said resilient means is arranged, said draw hooks each being pivotally supported at said opposite ends of said baulk.

5. The improved dobby according to claim 1, wherein the longitudinal axis of said guideway extends generally perpendicularly with respect to the direction of the movement of said draw hook.

* * * * *